US005562422A

United States Patent [19]

Ganzon et al.

[11] Patent Number: 5,562,422

[45] Date of Patent: Oct. 8, 1996

[54] LIQUID LEVEL CONTROL ASSEMBLY FOR PUMPS

[75] Inventors: Antonio T. Ganzon, Romulus; Shane B. Eddy, Mallory; Robert F. Tayne, Seneca Falls, all of N.Y.

[73] Assignee: Goulds Pumps, Incorporated, Fairport, N.Y.

[21] Appl. No.: 316,222

[22] Filed: Sep. 30, 1994

[51] Int. Cl.[6] ..... F04B 49/04

[52] U.S. Cl. ..... 417/40

[58] Field of Search ..... 417/40; 335/153; 200/84 C, 84 R; 29/622

[56] References Cited

U.S. PATENT DOCUMENTS

| | | | |
|---|---|---|---|
| 3,316,845 | 5/1967 | Schumann | 417/40 |
| 3,684,400 | 8/1972 | Einerson et al. | 417/40 |
| 3,897,172 | 7/1975 | Hall | 417/40 |
| 4,441,860 | 4/1984 | Tsujimoto | 417/40 |
| 5,030,803 | 7/1991 | Yarbrough | 417/40 |
| 5,297,939 | 3/1994 | Orth et al. | 417/40 |
| 5,324,171 | 6/1994 | Cook | 417/40 |

*Primary Examiner*—Timothy S. Thorpe
*Assistant Examiner*—Xuan M. Thai
*Attorney, Agent, or Firm*—Brezina & Ehrlich

[57] ABSTRACT

A switch for a liquid level control is activated by a switch actuator with a magnetic portion when the magnetic portion is drawn to a magnetic actuator brought into proximity with the switch actuator when a particular liquid level has been reached. The magnetic actuator and switch are in isolated portions of a unitary housing and may be submersed without detrimental effect to the operation of the level control switch.

15 Claims, 2 Drawing Sheets

LIQUID LEVEL CONTROL ASSEMBLY FOR PUMPS

BACKGROUND OF THE INVENTION

The present invention relates generally to actuating switches for use in centrifugal pumps. The invention relates more particularly to actuating switches as commonly used in pumps partially submerged in a receiving basin or vessel which selectively operate the pump to maintain the liquid level in the vessel in a desired range.

Actuators or switches used to selectively operate pumping systems are frequently subjected to adverse conditions. Typical conditions include complete, or partial submersion of the pumping system in a liquid such as water. Over the years industry has developed a need for pump actuating systems which can withstand such conditions foe extended periods and function reliably.

Previous attempts to respond to this need have typically involved placing a sensing element remote from the pump and operably attaching the sensing element to the pump. In addition, previous solutions have incorporated isolated switches housed within protective chambers, but the switches typically incorporate complicated switching mechanisms. Some examples include switches incorporating conductive liquids and switches activated through elaborate mechanical systems. In addition, switching devices were frequently housed in multiple piece chambers which utilized gaskets and other sealing means to protect the switching elements from the environment. These sealing arrangements may be prone to undesirable leakage.

Thus, it is an object of the present invention to provide an improved actuating system for use in centrifugal pump systems which reduces the interfaces which must be sealed to isolate the switching element from the environment around the pump.

It is a further object of the invention to provide an improved actuating system for centrifugal pumps which makes use of a novel arrangement of simple mechanical switching elements.

SUMMARY OF THE INVENTION

The present invention finds particular application in the operation of a pump to control the liquid level within a collection vessel or drain such as are normally found in the basements of homes. Such use of the pump requires that the pump be partially or completely submersible. Accordingly the present invention includes a switch which is controlled by a mechanical switch actuator. Both the switch and switch actuator are housed within a switch housing molded as to be a part of or bolted to the pump body. The configuration of the actuator may be adapted to operate in conjunction with mechanical snap action switches of various sizes and configurations. The actuator possesses a portion which may be attracted by a magnetic force. At least one of the switch actuator and a magnetic actuator includes a magnet for supplying a magnetic force to cause the switch actuator to change position and operate the switch. The magnetic actuator is movably disposed in an actuator chamber which is isolated from the switch actuator by a dividing wall integrally formed by the switch housing.

For operation in a liquid level control system for the pump, the magnetic actuator moves in response to liquid levels. When the liquid level within the vessel rises, a float assembly housed within the vessel and operably connected to the magnetic actuator moves the magnetic actuator into proximity with the switch actuator, so that the magnetic force changes the position of the switch actuator operating the switch. In a preferred embodiment, the float assembly includes a rod and a float. As the float reaches a predetermined level under the influence of a rising fluid level, the float engages the rod and moves the magnetic actuator closer to the magnetic portion of the switch actuator. In response to magnetic force between the magnetic actuator and switch actuator, the switch actuator changes position which causes operation of the switch thereby activating the pump.

DETAILED DESCRIPTION OF A PREFERRED EMBODIMENT

Figure 1:
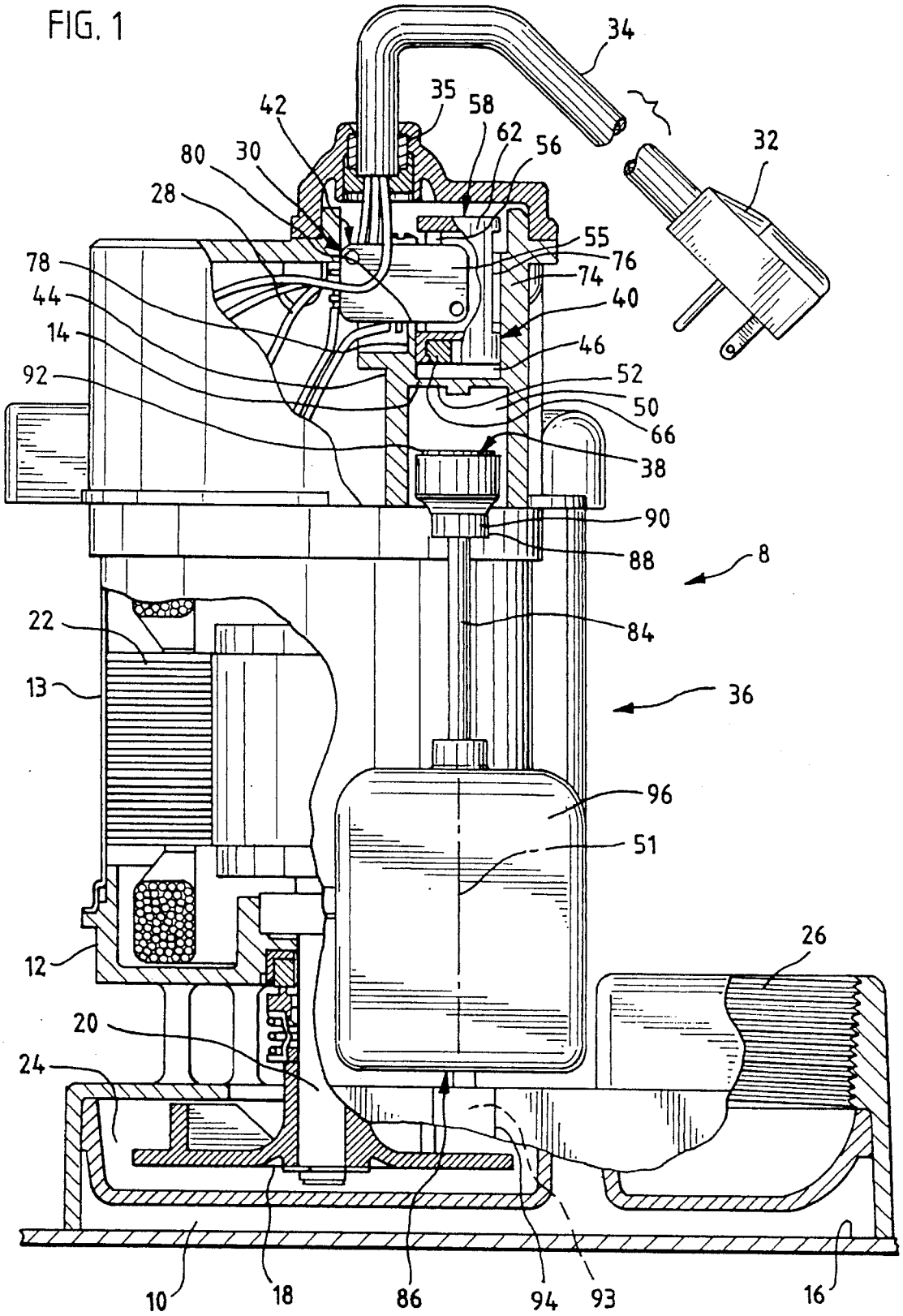
FIG. 1 shows a partial cut-away view of a pump including a liquid level control switch system constructed in accordance with a preferred embodiment of the present invention.

Referring to FIG. 1, a submersible pump including a liquid level control system in accordance with a preferred embodiment of the present invention is generally indicated at 8.

The pump 8 includes a lower impeller casing 10. A seal housing 12 is connected above the impeller casing 10. Mounted above and sealingly connected to the seal housing 12 is a motor housing assembly 13. A switch system housing 14 may be located above and integrally joined with the motor housing assembly 13 or attached using other methods such as a bolting arrangement. The pump 8 is generally located within a receiver basin or collection vessel, partially shown at 16.

The casing 10 houses an impeller 18 connected by a shaft 20 to a motor 22 within the motor housing 13. The shaft 20, impeller 18, and motor 22 are vertically aligned. Liquids within the vessel 16 collect within an impeller chamber 24 formed by the seal housing 12 and impeller casing 10. When the motor 22 is operated, rotation of the impeller 18 in the chamber 24 causes liquids within the chamber to be ejected through a discharge port 26.

The motor housing assembly 13 isolates the motor 22 from the vessel 16 and the environment around the pump 8. The motor housing 13 is sealingly connected to the switch system housing 14 and also sealingly connected to the seal housing 12. Preferably, the motor housing 13, switch housing 14, and seal housing 12 are constructed with a suitably rigid material preferably impervious to liquids, solids and gases. A switching system, shown generally at 30, housed within the switch system housing 14 selectively supplies power to the motor 22 through electrical leads 28. Preferably, power is supplied to the switching system 30 from an external connection through a standard plug 32 and cord 34 connection, the cord 34 entering the switch system 30 through a sealed cord entry 35.

The switching system 30 supplies power to the leads 28 when a float assembly for tracking liquid levels, shown generally at 36, within the vessel partially shown at 16 causes a magnetic actuator assembly, shown generally at 38, to rise and be brought into proximity with a switch actuator assembly, shown generally at 40. The switch actuator assembly 40 is magnetically attracted to the magnetic actuator assembly 38 causing the switch actuator assembly 40 to move downward and activate a mechanically activated switch, shown generally at 42, such as a snap-type switch or the like which forms a part of the switching system 30. When power is supplied by the switching system 30, the motor 22 operates to rotate the impeller 18 which causes liquids to be ejected through discharge port 26.

The switch system housing 14 is preferably a unitary housing structure 44 and magnetically neutral. The housing structure 44 forms a switch chamber 46 and a generally downward opening actuator chamber 50 along a generally vertical axis 51. The actuator chamber 50 is disposed below the switch chamber 46 and isolated from the switch chamber by a dividing wall 52. Because the switch chamber 46, actuator chamber 50 and dividing wall 52 all are formed by the unitary housing 44, the dividing wall prevents leakage between the actuator chamber 50 and the switch chamber 46 without the use of sealing means such as gaskets which may be prone to such leakage. The housing 44 also seals the switch chamber 46 from the environment around the pump 8.

Slidably disposed within the switch chamber 46 is the switch actuator assembly 40 for operating the switch 42. The switch actuator 40 partially surrounds the mechanically activated electrical switch 42 within the switch chamber 46. The electrical switch 42 includes a switch housing 55 and a switch button 56 which projects upward from a top surface of the housing 55. Depression of the button 56 closes the switch 42 so that power flows to the motor. The button 56 is biased upward through spring tension within the button 56 so that the button normally remains in the upper position, with the switch 42 open, unless a downward force sufficient to overcome the spring bias is applied to the button 56.

Figure 2:
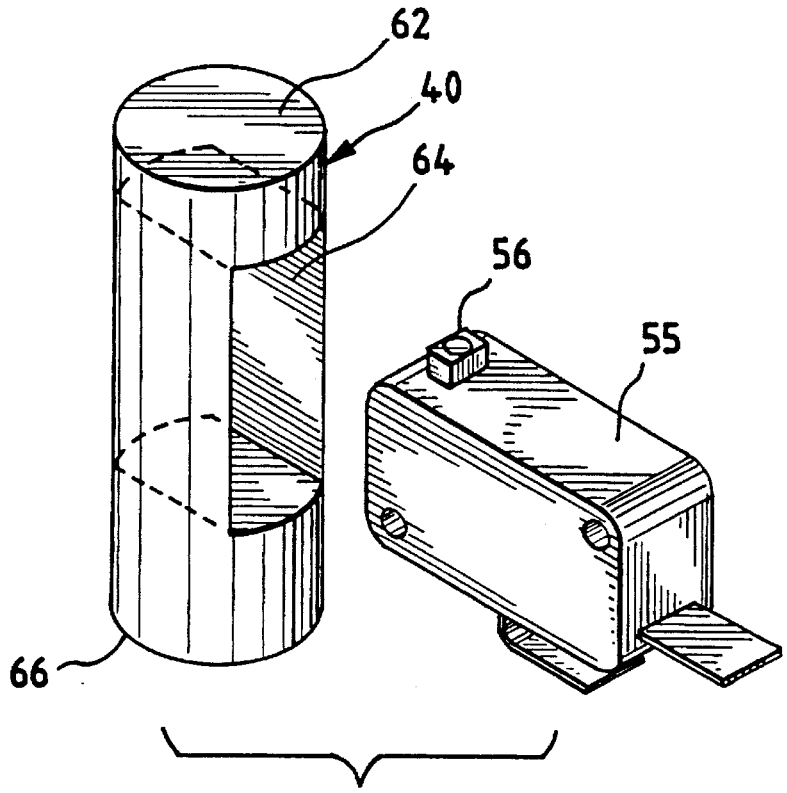
FIG. 2 is an exploded perspective view of a switch actuator plunger and switch forming a part of the liquid level control switch system of FIG. 1.
Figure 3:
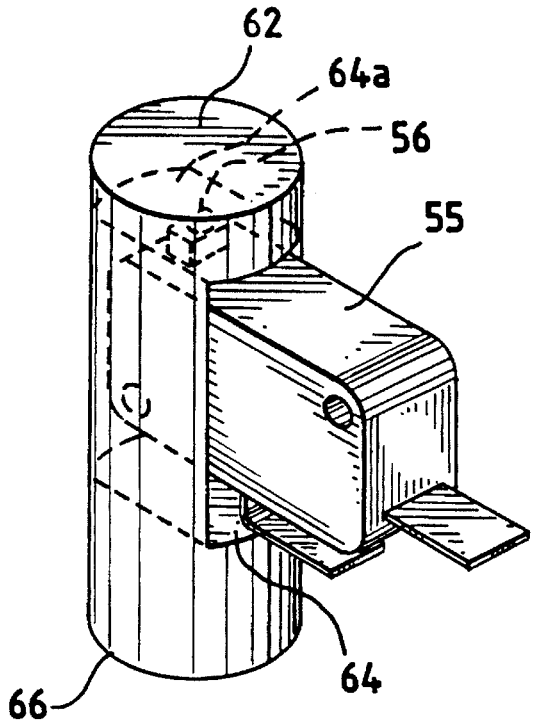
FIG. 3 is a perspective assembly view of the switch actuator plunger and switch shown in FIG. 2.

The structure of the mechanically activated switch 42 and the switch actuator assembly 40 will now be described more particularly with reference to FIGS. 1, 2 and 3. The switch actuator assembly 40 of the preferred embodiment includes a plunger 62. In the preferred embodiment, the plunger 62 is cylindrical in shape. Other shapes and configurations may be used to suit a particular application. Within the plunger 62 is a transversely extending slot 64. The slot 64 is essentially rectangular to slidingly conform to the shape of the switch housing 55 used in the preferred embodiment of FIG. 1. A rear portion of the switch housing 55 having the upward extending button 56 extends into the slot 64 in the assembled position (FIG. 3). The button 56 contacts an upper surface 64a of the slot 64 and supports the plunger 62 by the upward bias force of the button 56. The plunger 62 includes a magnetic base 66 making the plunger 62 responsive to the application of magnetic force. The magnetic base 66 is preferably magnetized but it may also be a substance such as iron which is attracted to a magnet.

Returning to FIG. 1, the placement of the plunger 62 and switch 42 within the switch chamber 46 is shown. The plunger 62 is supported by the biased switch button 56 which holds the plunger 62 above the dividing wall 52. A section 78 of the housing 44 which defines a lower portion of the switch chamber 46 is formed in a shape corresponding to the shape of the plunger 62 so that movement of the plunger is restricted to sliding in a vertical direction along the axis 51. In addition, the housing 44 provides a mount 80 for fixedly retaining the switch housing 55.

The magnetic actuator assembly 38 and the float assembly generally indicated at 36 will now be described in more detail with reference to FIG. 1. In the preferred embodiment the float assembly 36 is operably connected to the magnetic actuator 38. The float assembly 36 is exposed to the liquid levels within the vessel partially shown at 16 and extends upward to the actuation chamber 50 where connection is made between float assembly 36 and magnetic actuator 38. The float assembly 36 and magnetic actuator 38 are vertically centered on the axis 51 which also extends through the center of the plunger 62.

The float assembly 36 includes a generally vertical float rod 84 preferably extending along the axis 51 and having a fixed or adjustable lower stop 86 and upper stop 88 connected to the float rod 84. A magnetic actuator disc 92 forming part of the magnetic actuator 38 is mounted to the upper end 90 of the rod 84. The magnetic actuator disc 92 is preferably magnetized and attracts the magnetic base 66 of the plunger 62. It is also contemplated that if the magnetic base 66 of the plunger is magnetized, the disc 92 may be composed of a material such as iron which is attracted by a magnetic force.

A lower end 93 of the rod 84 is slidably retained in a collar 94 attached to the seal housing 12 so that the entire float rod assembly 36, including the rod end 90, upper stop 88, and lower stop 86 are free to move upward from the position depicted in FIG. 1. The upper limit of the travel of disc 92 under the influence of the float rod assembly 36 is defined by the dividing wall 52. The float assembly 36 includes a float 96 slidably disposed on the rod 84; however, the vertical travel of the float 96 along the rod 84 is constrained by upper stop 88 and lower stop 86.

The operation of the switching system will now be described with reference to FIG. 1.

The upward biasing force of the switch button 56 supports the plunger 62 in an upper position. In this upper position, the switch 42 is open and power from the plug 32 and cord 34 is not supplied to the motor 22 through the leads 28.

As the liquid level around the pump rises, the float 96 also rises and travels vertically along the float rod 84. When the float 96 reaches the upper stop 88 near the top of the float rod 84, the upward force exerted by the float 96 on the stop 88 lifts the float rod 84 and magnetic actuator disc 92. This lifting of the magnetic actuator disc 92 brings the magnetic actuator disc in close proximity to the magnetic base 66 of the plunger 62 which is on the opposite side of the dividing wall 52. During the upward travel of the magnetic actuator disc 92, a point will be reached when the force of attraction between the magnetic base 66 of the plunger 62 and the magnetic actuator disc 92, combined with the gravitational force associated with the plunger 62, forms a downward force on the plunger which is sufficient to overcome the upper biasing force of the switch button 56. As a result, the plunger 62 is pulled downward along the axis 51 and toward the dividing wall 52. This action depresses the switch button 56, causing the circuit between the plug 32 and the motor leads 28 to close, activating the motor 22 to operate the pump. The motor 22 rotates the impeller 18 drawing liquid within the vessel 16 into the impeller chamber 24 and expelling the liquid out of the vessel through the discharge port 26, thus lowering the level of liquid in the vessel.

As the liquid level surrounding the pump decreases as a result of pump operation, the float 96 travels downward along the float rod 84 until the float 96 reaches the lower stop 86. Until the float 96 reaches lower stop 86 the button remains depressed. Once the float 96 reaches the lower stop 86, further lowering of the liquid level causes the weight of the float 96 to push down on the lower stop 86. The combined weight of the float 96 and the rod assembly 36 is sufficient to overcome the magnetic attraction between the magnetic actuator disc 92 and the magnetic base 66 of the plunger 62. The magnetic actuator 38 is then lowered downward away from the plunger 62, weakening the magnetic force of attraction between the plunger and actuator.

With a weakened magnetic force, the upward biasing force of the switch button 56 forces the plunger 62 upward, thus causing the circuit between the motor leads 28 to open and the power source connected through plug 32 to be disconnected from motor 22 thus stopping operation of the pump.

By changing the positions of the lower stop 86 and upper stop 88, the liquid levels at which the motor 22 and therefore the pump 8 are activated and deactivated may be adjusted to establish different acceptable levels of liquid.

Other configurations are possible without departing from the scope of the present invention. For instance, the magnetic force between the plunger and the magnetic actuator may be attractive or repulsive, depending upon the direction of desired switch button movement. Similarly, movement of the magnetic actuator could be made responsive to various physical phenomena such as pressure or heat. The particular shape and dimensions of the plunger could be changed to accommodate a variety of different mechanically activated switching means. Similarly, a mechanically activated switch with pull or throw actions could be accommodated by the plunger in the preferred embodiment or a slight variation thereof. Numerous other embodiments will be apparent to an artisan from the teaching of the present invention without departing from the scope of the present invention as defined in the appended claims.

What is claimed is:

1. A magnetically actuated switch apparatus forming a part of a submersible pump assembly adapted for fluidly displacing liquid from a vessel in which at least a portion of said pump assembly is disposed, said pump assembly including an impeller movably disposed in an impeller chamber formed by the pump, and a motor housed in a motor housing forming a part of the pump and operably attached to the impeller, said switch apparatus comprising:

a unitary housing structure sealingly attached to said motor housing, said structure forming an internal switch chamber and an external actuator chamber, said external actuator chamber disposed external to said housing structure and integrally formed therewith to environmentally seal and isolate said actuator chamber from said housing structure and said switch chamber;

a lower actuator movably disposed within said actuator chamber;

a switch means disposed within said switch chamber for selectively activating said motor;

a switch actuator within said switch chamber, said switch actuator contacting and partially surrounding said switch means, said switch means including means for biasingly supporting said switch actuator at a vertical position, said switch actuator having a lower portion with at least one of said lower portion of said switch actuator and said lower actuator being magnetic and the other being attracted by a magnetic force; and a liquid level assembly means operably connected to said lower actuator for moving said lower actuator toward said switch actuator in response to a rising liquid level, and away from said switch actuator in response to a lowering liquid level, said lower actuator when in proximity to said switch actuator causes said switch actuator to overcome the support force of said biased support means and move slidably downwards within said switch chamber to activate the switch means.

2. The apparatus of claim 1 wherein said actuator chamber is vertically aligned below said switch chamber and opens downward, said actuator chamber being isolated from said switch chamber by a dividing wall which is an integral part of said unitary housing structure.

3. The apparatus of claim 1 wherein said switch actuator includes a hollow portion, at least a portion of said switch extending into said hollow portion, said magnetic portion being generally about the base of said switch actuator, said switch actuator being slidably disposed within said switch chamber, a portion of said switch chamber being configured to guide movement of said switch actuator along an axis.

4. The apparatus of claim 2 wherein said liquid level assembly includes;

a rod with upper and lower stops, said rod being generally vertically aligned with said switch chamber, said rod having an upper end above said upper stop and within said actuator chamber, said lower actuator being attached to said upper end, and a float movably mounted on said rod.

5. The apparatus of claim 4 wherein said upper stop is positioned on said rod at a predetermined location so that when the liquid level in the basin reaches a predetermined upper level said float lifts said rod and rod end to bring said magnetic actuator in close proximity to said magnetically attractable portion of said switch actuator.

6. The apparatus of claim 5 wherein said upper stop is positioned on said rod so that when the level of the liquid in said basin reaches the predetermined level, the contact between said float and said upper stop is sufficient to move said lower actuator to an upper position where a magnetic attraction between said lower actuator and said switch actuator is sufficient to overcome the bias support force applied on said switch actuator by said switch means to cause said switch actuator to move downward and activate said switch means.

7. The apparatus of claim 6 wherein said lower stop is positioned on said rod so that when the liquid level in said vessel lowers to a predetermined level said float contacts said lower stop and the contact force is sufficient to lower said rod, said lower actuator moving down thereby allowing the bias support force applied by said switch means on said switch actuator to overcome the magnetic attraction between said lower actuator and said switch actuator and move said bias support means and said switch actuator upward to an off position.

8. The apparatus of claim 1 wherein said switch actuator forms a hollow portion, at least a portion of said switching means extending into said hollow portion, said magnetically attractable portion forming a lower portion of said switch actuator, said switch actuator being movably disposed within said switch chamber.

9. The apparatus of claim 8 wherein said switch chamber is configured to restrict movement of said switch actuator along a vertical axis.

10. A magnetically actuated switching assembly for a submersible pump with a motor within a motor housing above and connected to an impeller casing, said switch apparatus controlling the supply of power to said motor and comprising:

unitary housing means attached to said motor housing for forming a switch chamber and an actuator chamber, said actuator chamber disposed external to said unitary housing means and integrally formed therewith to environmentally seal and isolate said actuator chamber from said housing means and said switch chamber;

a mechanically activated electrical switching means for controlling power supply to said pump, and a switch actuation means for controlling the operation of said switching means, said electrical switching means and said switch actuation means disposed in said switch chamber, said switch actuation means forming a hollow portion, said switching means at least partially extending into said hollow portion, said switch actuation means contacting and normally being held in a non-operational position by a biased switch button forming a part of said electrical switching means; and magnetic actuation means movably disposed within said actuator chamber for magnetically inducing movement of said switch actuation means in response to a change in liquid level around said pump.

11. The apparatus of claim 10 wherein said electrical switching means is fixedly held by said housing means.

12. The apparatus of claim 10 wherein said switch chamber is configured to guide movement of said switch actuation means.

13. The apparatus of claim 12 further comprising:

liquid level response means vertically aligned with and connected to said magnetic actuation means to move said magnetic actuation means in close proximity to said switch actuation means in response to increased liquid levels around said pump, and moving said magnetic actuation means away from said switch actuation means in response to decreased liquid levels around said pump.

14. The apparatus of claim 13 wherein said liquid level response means includes;

a rod with upper and lower stops, said rod being generally vertically aligned with said switch chamber, said rod having an upper end above said upper stop, and said magnetic actuation means being attached to said upper end, and a float movably mounted on said rod, said upper stop is positioned on said rod at a predetermined location so that when the liquid level in a vessel in which the submersible pump is disposed, reaches a predetermined upper level, said float contacts and lifts said rod and rod end to bring said magnetic actuation means to a position whereby a magnetic attraction between the magnetic actuator and said switch actuator is sufficient to overcome the bias support force applied on said switch actuator by said switch means to cause said switch actuator to move downward and activate said switch means.

15. The apparatus of claim 14 wherein said lower stop is positioned on said rod so that when the liquid level in said vessel lowers to a predetermined level said float contacts said lower stop and the contact force is sufficient to lower the rod, said magnetic actuator moving down thereby allowing the bias support force applied by said switch means on said switch actuator to overcome the magnetic attraction between said magnetic actuator and said switch actuator and move said bias support means and said switch actuator upward to an off position.

* * * * *